US011154176B2

(12) United States Patent
Roberts

(10) Patent No.: US 11,154,176 B2
(45) Date of Patent: Oct. 26, 2021

(54) MOP WITH INTEGRATED HEAD REMOVAL SYSTEM

(71) Applicant: Medline Industries, Inc., Mundelein, IL (US)

(72) Inventor: Derek Roberts, Chicago, IL (US)

(73) Assignee: Medline Industries, Inc., Northfield, IL (US)

( * ) Notice: Subject to any disclaimer, the term of this patent is extended or adjusted under 35 U.S.C. 154(b) by 1329 days.

(21) Appl. No.: 15/072,069

(22) Filed: Mar. 16, 2016

(65) Prior Publication Data

US 2017/0265704 A1 Sep. 21, 2017

(51) Int. Cl.
*A47L 13/256* (2006.01)
*A47L 13/44* (2006.01)

(52) U.S. Cl.
CPC ..... *A47L 13/256* (2013.01); *A47L 13/44* (2013.01)

(58) Field of Classification Search
CPC ..... A47L 13/24; A47L 13/20; A47L 13/258; A47L 13/255; A47L 13/256; A47L 13/257; A47L 13/46; A47L 13/44; A47L 13/254; A47L 13/29; A47L 11/26; A47L 13/10; A47L 13/52; A47L 13/16; A61F 13/15764; B24B 7/18; A46B 5/0095
USPC ..... 15/147.1, 147.2, 228, 231
See application file for complete search history.

(56) References Cited

U.S. PATENT DOCUMENTS

| | | | | |
|---|---|---|---|---|
| 473,004 | A * | 4/1892 | Hull | A47L 13/52 15/257.4 |
| 7,530,139 | B2 | 5/2009 | Niemeyer et al. | |
| 8,464,391 | B2 | 6/2013 | Bober et al. | |
| 8,677,547 | B1 | 3/2014 | Morad et al. | |
| 8,701,238 | B1 | 4/2014 | Morad et al. | |
| 8,800,092 | B1 | 8/2014 | Morad et al. | |
| 2001/0013153 | A1* | 8/2001 | Zorzo | A47L 13/254 15/247 |
| 2006/0168750 | A1* | 8/2006 | Dotterman | A47L 13/256 15/228 |
| 2007/0022553 | A1* | 2/2007 | Niemeyer | A47L 13/256 15/228 |
| 2012/0301208 | A1* | 11/2012 | Hughes | B25G 1/04 401/137 |
| 2013/0340187 | A1* | 12/2013 | Bober | A47L 13/256 15/147.1 |

(Continued)

FOREIGN PATENT DOCUMENTS

| | | | | |
|---|---|---|---|---|
| EP | 1384430 | A2 * | 1/2004 | A47L 13/146 |
| WO | 2013166492 | | 11/2013 | |

(Continued)

*Primary Examiner* — Orlando E Aviles
*Assistant Examiner* — Aaron R McConnell
(74) *Attorney, Agent, or Firm* — Philip H. Burrus, IV

(57) ABSTRACT

A mop (100) includes a mop head (101) having a housing (302) defining a major surface to couple to a cleaning pad (204). One or more flappers (201,202) are disposed along the major surface. The flappers, in response to actuation of an actuator (104), selectively pivot from a closed position disposed within the housing and substantially parallel with the major surface to an angularly displaced open position extending distally outward from the major surface. A user actuates the actuator (104) to detach the cleaning pad from the major surface without having to handle the cleaning pad.

20 Claims, 5 Drawing Sheets

(56) References Cited

U.S. PATENT DOCUMENTS

2014/0007367 A1* 1/2014 Soller ..... A47L 13/46
15/231

FOREIGN PATENT DOCUMENTS

WO WO 2017083374 A1 * 5/2017 ..... A47K 11/10
WO WO-2017083374 A1 * 5/2017 ..... A47K 11/10

* cited by examiner

MOP WITH INTEGRATED HEAD REMOVAL SYSTEM

BACKGROUND

Technical Field

This disclosure relates generally to cleaning devices, and more particularly to cleaning mops having attachable cleaning devices.

Background Art

Conventional mops have a long handle and permanently attached head. The head, frequently manufactured from numerous strands of string cloth, are saturated in a bucket and swabbed across a floor. The bucket may include multiple reservoirs. For example, the bucket may have a clean water reservoir and a dirty water reservoir. After wetting the mop head in the clean water solution and passing the mop across the floor, it must be wrung out into the dirty water reservoir before it can again be wet in the clean water reservoir.

Such mops suffer from a number of issues. Illustrating by example, when the mop is used in a healthcare facility, the head can pick up pathogens and bacteria during the mopping process. No amount of wringing can completely dislodge these organisms from the mop head.

Consequently, the clean water reservoir can become contaminated after only one floor pass of the mop. Moreover, the wringing process requires the use of one's hands, which can be unpleasant, unclean, and, in some cases, unsafe due to the cross-contamination of pathogens and bacteria.

More modern mops employ detachable pads rather than a permanent head. A pre-wetted pad is attached to a mop head during the mopping process. Periodically, the pad is replaced with a new pad. While this type of mop eliminates the contamination of a clean water reservoir associated with permanent-head mops, it still requires a person to remove the used pad with their hands. It would be advantageous to have an improved mop.

Figure 1:
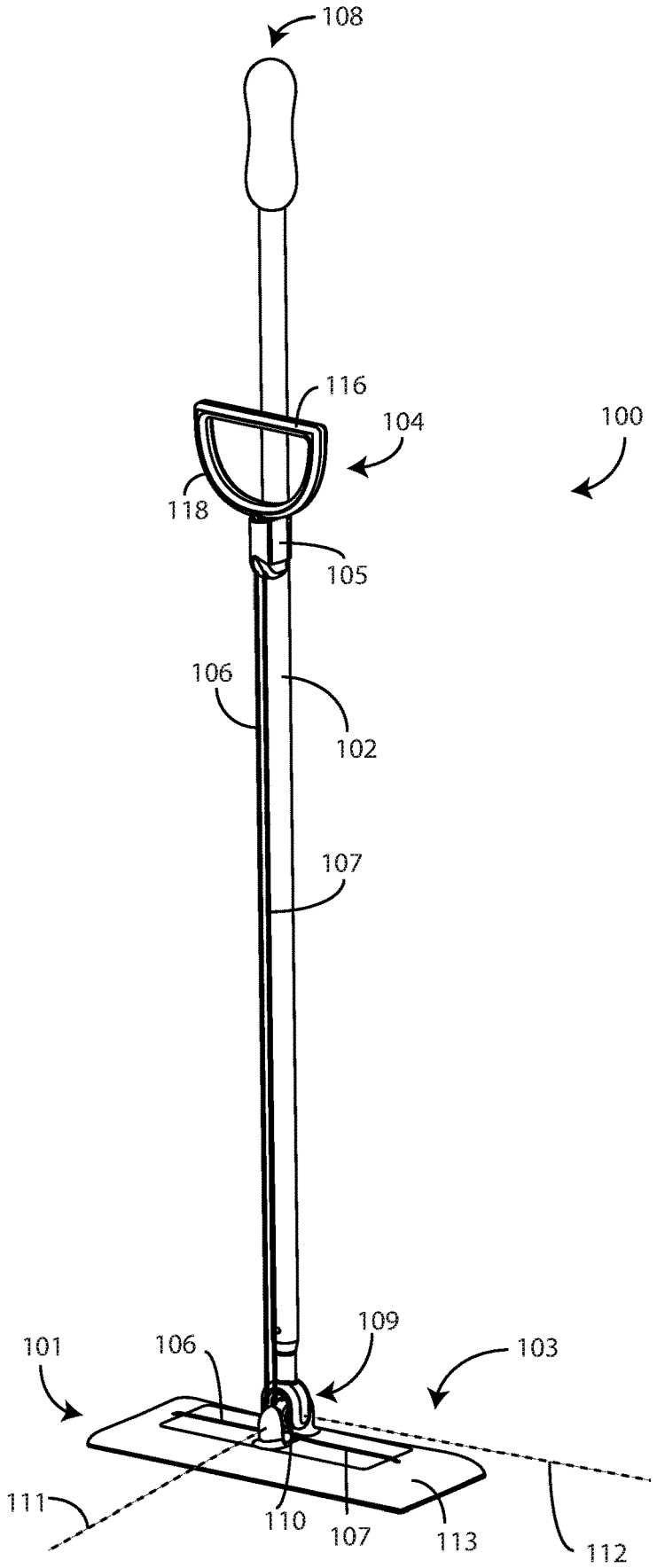
FIG. 1 illustrates one explanatory mop in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. As used herein, the terms "about" and "substantially" refer to orientations or alignments or measurements inclusive of manufacturing tolerances. Accordingly, a "substantially orthogonal" angle with a manufacturing tolerance of plus or minus two degrees would refer to an angle of between 88 and 92 degrees, inclusive. Also, reference designators shown herein in parenthesis indicate components shown in a figure other than the one in discussion. For example, talking about a device (10) while discussing figure A would refer to an element, 10, shown in figure other than figure A.

As noted above, many mops use detachable pads rather than a permanent head to avoid cross-contamination of soiled water and cleaning solution. This is especially true in healthcare complexes where the prevention of infection and disease due to cross-contamination is paramount. A pre-wetted, detachable pad is attached to a mop head. A user then mops a portion of the floor with the pad. Once the desired portion of the floor has been mopped, the user is then tasked with disposing the dirtied pad. Users frequently grasp the dirtied pad with their bare hands, remove it from the mop head, and dispose of it in the proper container. As noted above, this process is unpleasant and unclean, and can even be unsafe.

Embodiments of this disclosure provide a solution to this problem by providing a mop that includes a "hands free" head removal system that allows a user to detach a cleaning pad from a mop head without ever touching the pad. In one embodiment, a bottom surface of a housing defining a mop head includes two flappers that, when an associated actuator is actuated, pivot from a closed position, disposed within the housing and substantially parallel with the bottom surface, to an angularly displaced open position extending distally outward from the major surface, thereby detaching the cleaning pad from the mop head. In one embodiment, the flappers open from the middle of the mop head toward the outer edges of the mop head and stop at an angle that is substantially orthogonal with the bottom surface.

In one or more embodiments, the cleaning pad is attached to the bottom surface of the mop head by a fastener. One example of such a fastener is a hook and loop fastener. When the actuator, which is configured as a handle in one embodiment, is pulled distally away from the mop head, one or more flexible connectors or cables that wrap around a side of the flapper comprising a pivot and couple to another side of the flapper cause the flappers to pivot through the use of torque due to their geometry in relation to the flappers. This will be shown in more detail below with reference to FIGS. 4-5 below.

Figure 2:
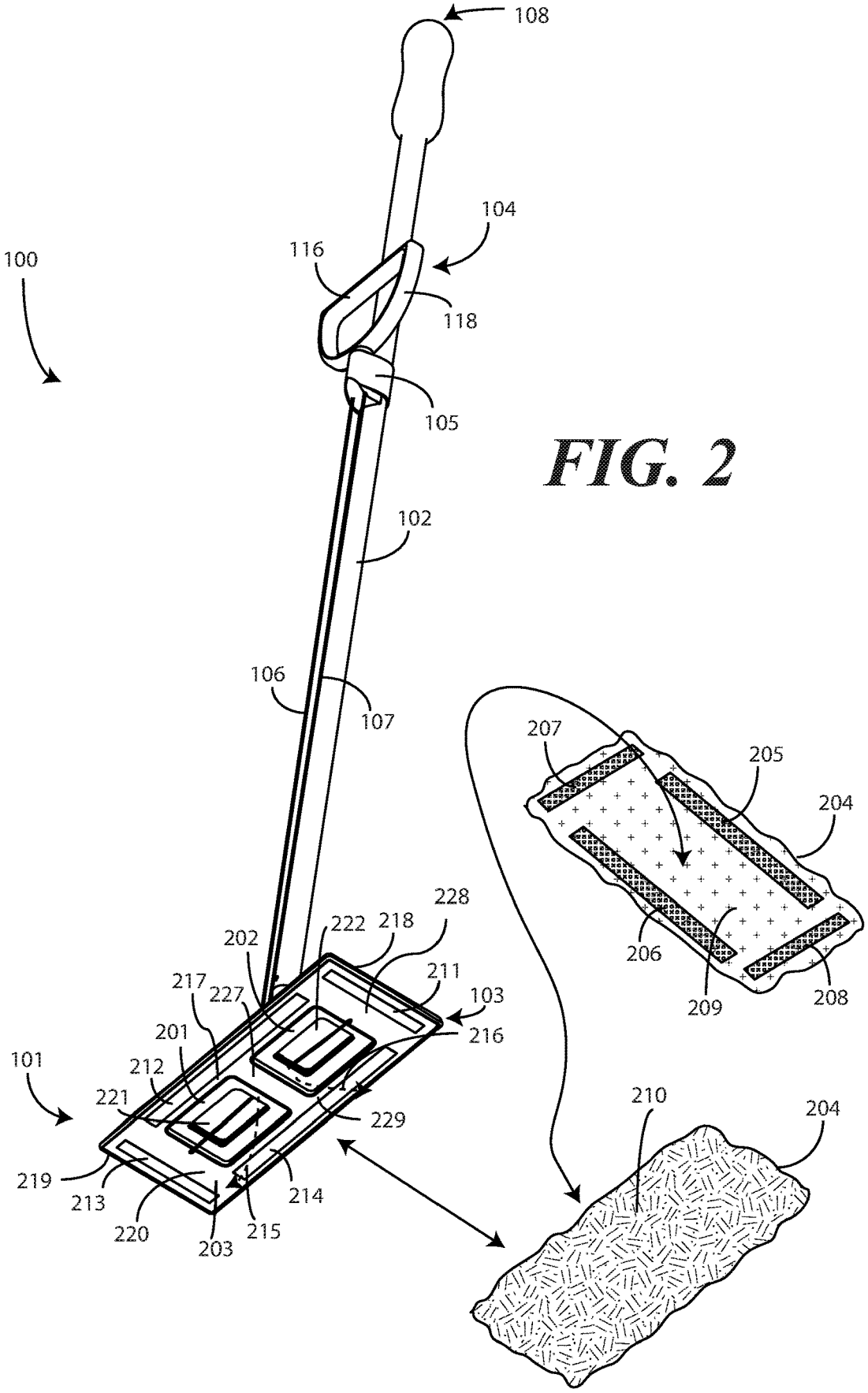
FIG. 2 illustrates one explanatory mop system in accordance with one or more embodiments of the disclosure.

Turning now to FIGS. 1 and 2, illustrated therein is one explanatory mop 100 in accordance with one or more embodiments of the disclosure. The mop 100 of FIG. 1 includes a mop head 101 coupled to a mop handle 102. The mop head 101 includes a top surface 103 and a bottom surface 203 that is configured to couple to a cleaning pad 204. The bottom surface 203 defines a major surface of the mop head 101 in this illustrative embodiment.

One or more flappers 201,202 are disposed within the mop head 101. As will be shown in more detail below with reference to FIG. 5, in one or more embodiments the one or more flappers 201,202 are operable to selectively pivot from a closed position (shown in FIG. 2) where each of the one or more flappers 201,202 is oriented substantially parallel with the bottom surface 203, to an angularly displaced open position (shown in FIG. 6) extending distally outward from the bottom surface 203 to detach the cleaning pad 204 from the mop head 101. In this illustrative embodiment, the one or more flappers 201,202 comprise a first flapper 201 and a second flapper 202. While two flappers are used in the illustrative embodiment of FIGS. 1 and 2, the use of more flappers or fewer flappers will be obvious to those of ordinary skill in the art having the benefit of this disclosure.

In one or more embodiments, the cleaning pad 204 includes one or more fasteners 205,206,207,208 disposed along the upper surface 209 of the cleaning pad 204. In this illustrative embodiment, the bottom surface 203 of the mop head 101 includes one or more complementary fasteners 211,212,213,214 operable to selectively attach to the one or more fasteners 205,206,207,208. Illustrating by example, in one or more embodiments the one or more fasteners 205, 206,207,208 comprise one of hook fasteners or loop fasteners, while the one or more complementary fasteners 211, 212,213,214 comprise another of hook fasteners or loop fasteners. For instance, in one embodiment the one or more fasteners 205,206,207,208 comprise hook fasteners while the one or more complementary fasteners 211,212,213,214 comprise loop fasteners. In another embodiment, the one or more fasteners 205,206,207,208 comprise loop fasteners while the one or more complementary fasteners 211,212, 213,214 comprise hook fasteners. While hook and loop fasteners are one example of fasteners suitable for selectively attaching the cleaning pad 204 to the mop head 101, embodiments of the disclosure are not so limited. Other types of fasteners could be used as well. For instance, in another embodiment, adhesive fasteners could be substituted for the hook and loop fasteners. In another embodiment, magnetic fasteners could be substituted for the hook and loop fasteners. Still other fasteners will be obvious to those of ordinary skill in the art having the benefit of this disclosure.

In the illustrative embodiment of FIGS. 1 and 2, the mop 100 also includes an actuator 104 disposed along the mop handle 102. In this illustrative embodiment, the actuator 104 is configured as a graspable handle 116 supported by a loop 118 that is attached to the mop handle 102 by a coupler 105. In one or more embodiments, the actuator 104 is tethered to the first flapper 201 and the second flapper 202 by one or more flexible connectors 106,107, cords, or cables. In one embodiment, a first flexible connector 106 couples the actuator 104 to the first flapper 201, while a second flexible connector 107 couples the actuator 104 to the second flapper 202. In one embodiment, each of the flexible connectors 106,107 comprises a single filament, synthetic cord such manufactured from a material such as Nylon. In other embodiments, the flexible connectors 106,107 can be manufactured from a multi-filament synthetic, organic, metallic, or other material. Other types of flexible connectors will be obvious to those of ordinary skill in the art having the benefit of this disclosure.

In one or more embodiments, the actuator 104 is operable to translate linearly through the coupler 105 away from the mop head 101 to transition the first flapper 201 and the second flapper 202 from the closed position to the angularly displaced open position. Said differently, in one embodiment a user can grasp the graspable handle 116 and pull it toward a distal end 108 of the mop handle 102 along a line parallel to a major axis of the mop handle 102 to transition the first flapper 201 and the second flapper 202 from the closed position to the angularly displaced open position. While linear translation is one method for actuating the actuator 104, embodiments of the disclosure are not so limited. In other embodiments, for example, the actuator 104 can pivot about the coupler 105 from a first position, where the graspable handle 116 is disposed between the coupler 105 and the mop head 101, to a second position, where the graspable handle 116 is disposed between the coupler 105 and the distal end 108 of the mop handle 102, to transition the first flapper 201 and the second flapper 202 from the closed position to the angularly displaced open position. Other methods for actuating the actuator 104 will be obvious to those of ordinary skill in the art having the benefit of this disclosure.

In one or more embodiments, the mop head 101 is coupled to the mop handle 102 by way of a coupler 109. In this illustrative embodiment, the coupler 109 comprises a bi-axial hinge 110. The bi-axial hinge 110 allows the mop head 101 to pivot both about a first axis 111 and a second axis 112 relative to the mop handle 102. Other couplers for connecting the mop head 101 to the mop handle 102 will be obvious to those of ordinary skill in the art having the benefit of this disclosure.

In one or more embodiments, the mop head 101 comprises a housing 113. The housing 113 can be manufactured from a thermoplastic material by way of an injection molding process. For example, in one embodiment, the housing 113 is manufactured from polypropylene. In another embodiment, the housing is manufactured from polycarbonate. It will be obvious to those of ordinary skill in the art having the benefit of this disclosure that other suitable rigid or semi-rigid materials may be substituted for the thermoplastic. Further, other manufacturing processes may be used to fabricate the housing 113, as will be readily obvious to those of ordinary skill in the art having the benefit of this disclosure.

As best shown in FIG. 2, in this illustrative embodiment each of the first flapper 201 and the second flapper 202 have a rectangular cross section. In this illustrative embodiment, each of the first flapper 201 and the second flapper 202 also defines a rectangular aperture 221,222 centrally disposed along each of the first flapper 201 and the second flapper 202, respectively. The rectangular apertures 221,222, while optional, reduce the overall mass of each flapper. They also allow liquids to flow through the flappers. While a rectangular cross section and apertures having corresponding shapes are illustrative examples of how the first flapper 201, the second flapper 202, and the rectangular apertures 221, 222 can be configured, these elements can take other shapes as well, including having circular shapes, triangular shapes, pentagonal shapes, and so forth. Similarly, while the first flapper 201 and second flapper 202 have rectangular cross sectional shapes like the rectangular apertures 221,222, in other embodiments the flapper shape and aperture shape can be different. For example, the flappers can be rectangular while the apertures are triangular, or vice versa. Other configurations will be obvious to those of ordinary skill in the art having the benefit of this disclosure.

In one or more embodiments, the first flapper 201 and the second flapper 202 are operable to pivot from the center 227 of the mop head 101 toward the right edge 218 and the left edge 219, respectively, when the actuator 104 is actuated. In one embodiment, when the actuator 104 is actuated to pull the first flexible connector 106 and the second flexible connector 107 toward the distal end 108 of the mop handle 102, the first flapper 201 is to pivot 215 one of clockwise or counterclockwise between the closed position and the angularly displaced open position, while the second flapper 202 is to pivot 216 another of clockwise or counterclockwise between the closed position and the angularly displaced open position. As best seen in FIG. 2, in this illustrative embodiment the first flapper 201 is to pivot 215 clockwise while the second flapper 202 is to pivot 216 counterclockwise. The movement of each of the first flapper 201 and the second flapper 202 from inner portion of the bottom surface 203 of the mop head 101 toward the outer edges, i.e., the right edge 218 and the left edge 219 of the mop head 101, advantageously assists in detaching the cleaning pad 204 from the bottom surface 203 of the mop head 101.

As best shown in FIG. 2, in one embodiment each of the first flapper 201 and the second flapper 202 are each disposed interior to the bottom surface 203 of the mop head 101, which means that portions 217,228,229,220 of the bottom surface 203 of the mop head 101 surround the first flapper 201 and the second flapper 202. In one or more embodiments, the portions 217,228,229,220 are at least one inch in width so that the first flapper 201 and the second flapper 202 are each surrounded by at least an inch of the bottom surface 203 of the mop head 101. This interior location allows the first flapper 201 and the second flapper 202 to seat within deeper portions of the mop head 101 when the upper surface 113 includes a contoured shape, as is the case in FIGS. 1 and 2, rather than being disposed adjacent to mop head sidewalls, e.g., right side 218 and left side 219. While this is one illustrative embodiment, in other embodiments the first flapper 201 and the second flapper 202 could be located at any location along the bottom surface 203 in other embodiments. Other locations for the first flapper 201 and the second flapper 202 will be obvious to those of ordinary skill in the art having the benefit of this disclosure.

Figure 3:
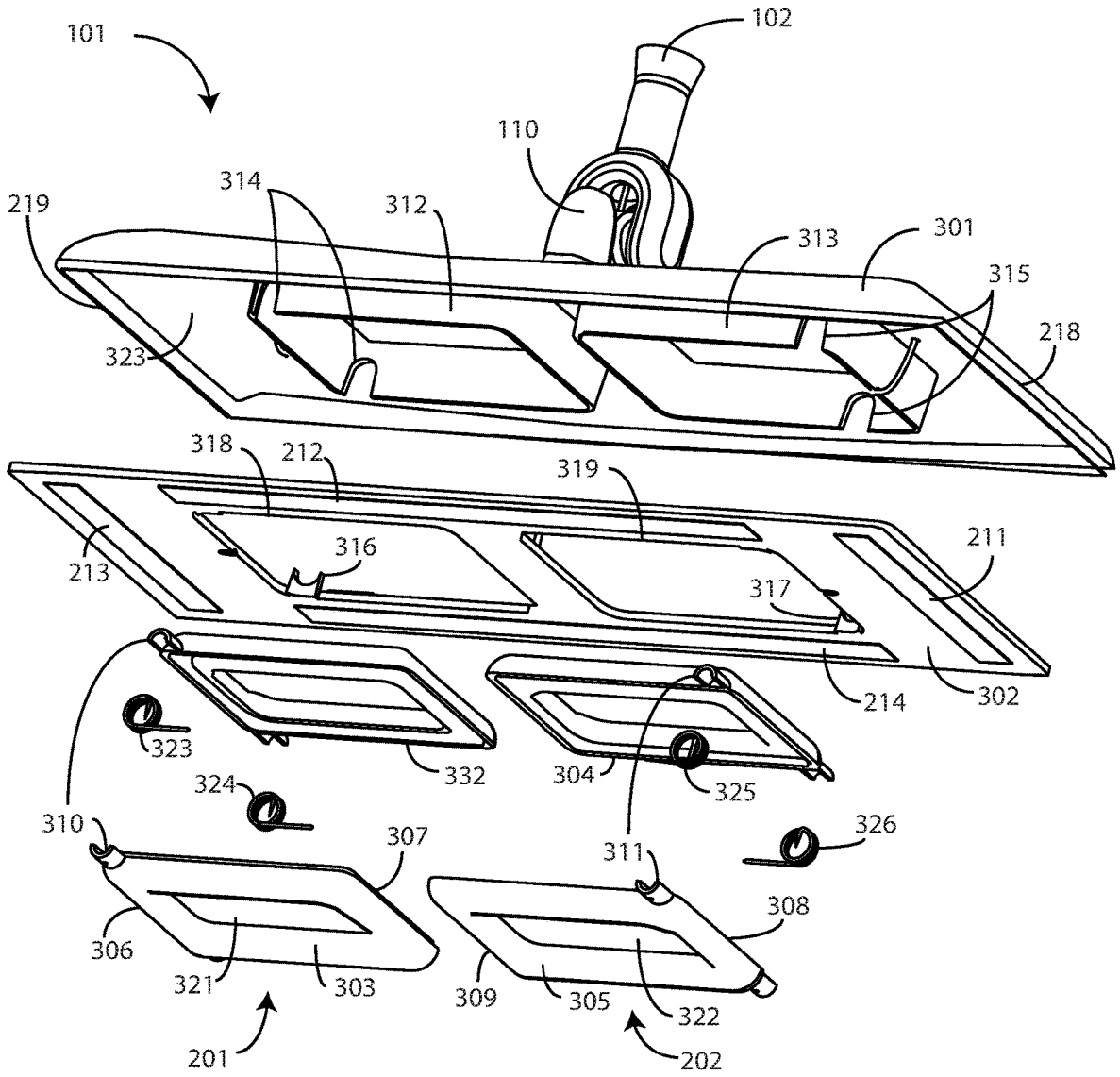
FIG. 3 illustrates an exploded view of one explanatory housing defining a mop head in accordance with one or more embodiments of the disclosure.

Turning now to FIG. 3, illustrated therein is an exploded view of the mop head 101. In this illustrative embodiment, the mop head 101 comprises an upper housing 301 and a lower housing 302. The lower housing 302 defines a major surface along the bottom side of the mop head 101 in this embodiment. This major surface is designed to couple to a cleaning pad (204) using one or more one or more complementary fasteners 211,212,213,214 operable to selectively attach to the one or more fasteners (205,206,207,208) disposed along an upper surface (209) of the cleaning pad (204).

In this illustrative embodiment, the upper housing 301 is coupled to the mop handle 102 by the bi-axial hinge 110. The mop handle 102 extends distally away from a side of the upper housing 301 disposed opposite side of the lower housing 302, which defines the major surface to which a cleaning pad (204) attaches. Said differently, the lower housing 302 and the mop handle 102 are disposed on opposite sides of the upper housing 301 in this illustrative embodiment.

In this illustrative embodiment, the first flapper 201 and the second flapper 202 have each been manufactured as two-piece components. Specifically, the first flapper 201 comprises an upper half flapper 332 and a lower half flapper 303, while the second flapper 202 comprises an upper half flapper 304 and a lower half flapper 305. Using two-piece construction advantageously allows the half flappers to more easily be pulled from an injection-molding tool. However, in other embodiments the first flapper 201 and the second flapper 202 could be manufactured as unitary parts.

In this illustrative embodiment, the first flapper 201 has a first side 306 and a second side 307. Similarly, the second flapper 202 has a first side 308 and a second side 309. The first sides 306,308 of the first flapper 201 and the second flapper 202 each comprise a pair of distally extending bosses defining a pivot 310,311. The second sides 307,309 are distally disposed from the first sides 306,308 of the first flapper 201 and the second flapper 202.

As shown in FIG. 3, in this illustrative embodiment each of the first flapper 201 and the second flapper 202 defining a central aperture 321,322 disposed between the first sides 306,308 and the second sides 307,309. Additionally, as noted above, each of the first flapper 201 and the second flapper 202 are rectangular in cross section in this embodiment. As shown in FIG. 3, in this embodiment the sides of the first flapper 201 and the second flapper 202 are rounded so as to define a circular cross section taken across any one leg of the first flapper 201 and the second flapper 202, respectively. Accordingly, the first flapper 201 and the second flapper 202 each define a rectangular torus in this illustrative embodiment. As noted above, in other embodiments the first flapper 201 and the second flapper 202 could take other shapes as well.

In one embodiment, the upper housing 301 of the mop head 101 defines a first receiver 312 and a second receiver 313. In this embodiment, the first receiver 312 and the second receiver 313 each comprise an annular wall extending distally from an interior surface 323 of the upper housing 301. When the first flapper 201 is disposed within the mop head 101, in one embodiment it sits within the first receiver 312 such that the pivot 310 nests within one or more peninsular apertures 314 of the first receiver 312. Similarly, when the second flapper 202 is positioned within the second receiver 313, it sits within the second receiver with its pivot 311 nested within one or more peninsular apertures 315 of the second receiver 313. The lower housing 302 can then include complementary pivot receivers 316,317 to retain the pivots 310,311 nested within the first receiver 312 and the second receiver 313, respectively, when the lower housing 302 is attached to the upper housing 301.

In a default configuration, the first flapper 201 and the second flapper 202 sit within the mop head 101 disposed along the major surface defined by the lower housing 302. As shown in FIG. 3, the lower housing 302 includes two apertures 318,319 through which the first flapper 201 and the second flapper 202 selectively pivot from the closed position disposed within the upper housing 301 and substantially parallel with the major surface defined by the lower housing 302 to an angularly displaced open position extending distally outward from the major surface defined by the lower housing 302. In this illustrative embodiment, the one or more complementary fasteners 211,212,213,214 are disposed along the major surface defined by the lower housing 302 exterior to the perimeters of the one or more apertures 318,319.

In this illustrative embodiment, the first flapper 201 and the second flapper 202 are configured as mirror images of each other, with the second sides 307,309 disposed toward the center of the mop head 101, and the first sides 306,308 disposed toward the left side 219 and right side 218 of the mop head 101, respectively. Said differently, in this illustrative embodiment the second sides 307,309 of the first flapper 201 and the second flapper 202 are disposed between the first sides 306,308 of the first flapper 201 and the second flapper 202. This mirror image configuration allows the first flapper 201 and the second flapper 202 to pivot in opposite directions when the actuator (104) is actuated as previously described.

In one or more embodiments, the first flapper 201 and the second flapper 202 each include one or more springs to apply a loading force to bias the first flapper 201 and the second flapper 202 toward the closed position. In this illustrative embodiment, the first flapper 201 includes a first spring 323 and a second spring 324 to apply a loading force to bias the first flapper 201 in the closed position. Each spring is operable at each distally extending boss defining the pivot 310 of the first flapper 201. Similarly, the second flapper 202 includes first spring 325 and a second spring 326 to apply a loading force to bias the second flapper 202 in the closed position. Each spring is operable at each distally extending boss defining the pivot 311 of the second flapper 202.

Turning now back to FIG. 2, once the components of the exploded view of FIG. 3 are assembled, the first flexible connector 106 and the second flexible connector 107 can be coupled between the actuator 104 and the first flapper 201 and second flapper 202, respectively. In this illustrative embodiment, the first flexible connector 106 and the second flexible connector 107 are coupled to the second sides (308,309) of the first flapper 201 and the second flapper 202, respectively. The first flexible connector 106 and the second flexible connector 107 then extend about the first sides (306,307) of the first flapper 201 and the second flapper 202, respectively. The first flexible connector 106 and the second flexible connector then pass through apertures the upper housing (301) of the mop head 101 to the actuator 104 disposed along the mop handle 102. As noted above, when the actuator 104 translates parallel to the mop handle 102 away from the upper housing (301), this cause the first flapper 201 and the second flapper 202 to selectively pivot 215,216 from the closed position to the angularly displaced open position. This action is shown in FIGS. 4 and 5.

Figure 4:
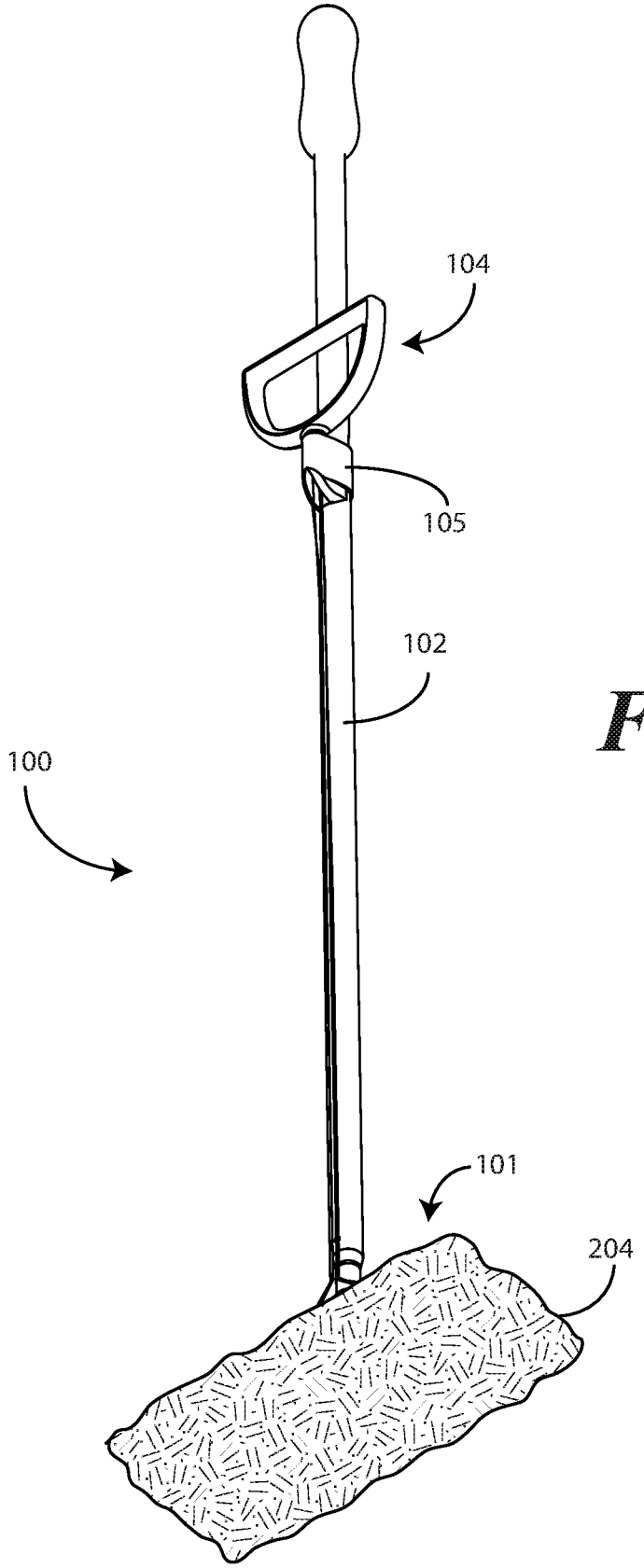
FIG. 4 illustrates one explanatory mop in a first state where one or more flappers of the mop are in a closed position disposed within the mop head and oriented substantially parallel with a major surface of a housing defining the mop head.

Beginning with FIG. 4, a cleaning pad 204 is attached to the bottom surface (203) of the mop head 101. The actuator 104 is positioned against the coupler 105, i.e., has been translated parallel to the mop handle 102 toward the mop head 101. Accordingly, the first flapper (201) and the second flapper (202) are retracted, in one embodiment with the assistance of one or more springs (323,324,325,326) to a closed position disposed within the upper housing (301) and substantially parallel with the major surface defined by the bottom surface (203) of the mop head 101. Accordingly, the mop 100 can be used for cleaning processes.

Figure 5:
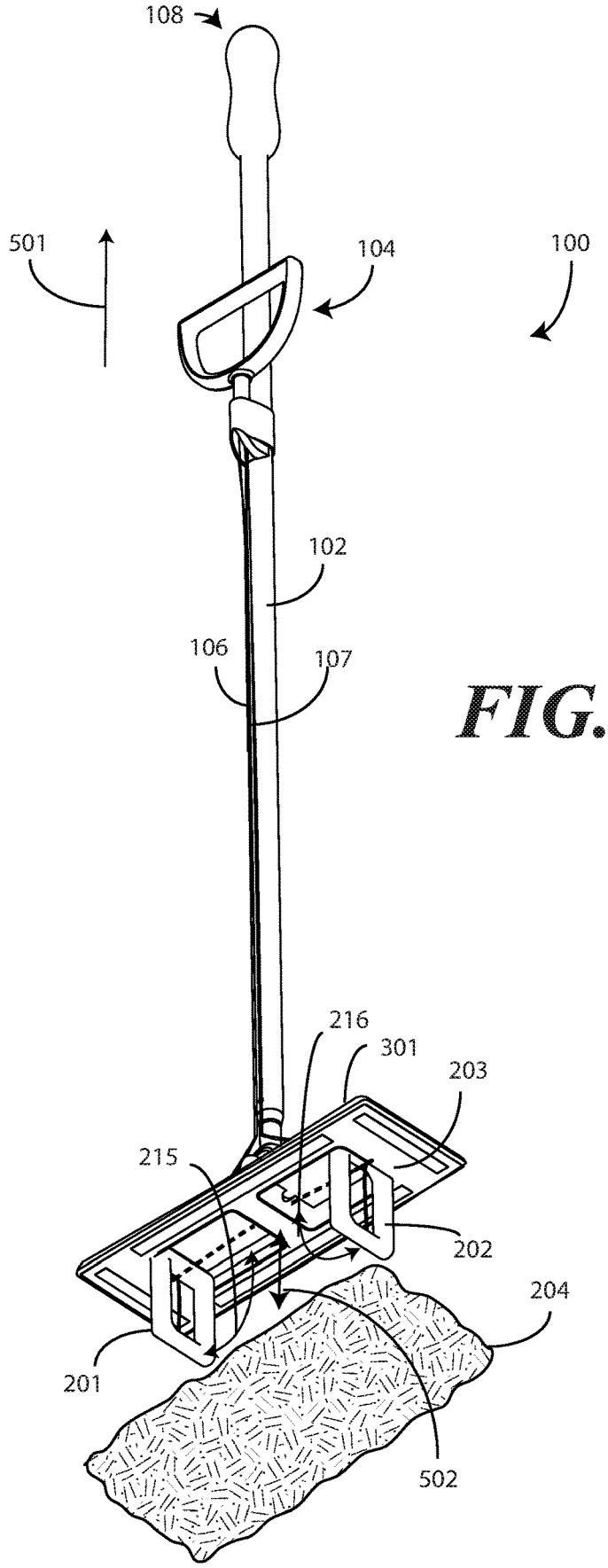
FIG. 5 illustrates one explanatory mop in a second state where one or more flappers of the mop are pivoted to an angularly displaced open position extending distally away from a major surface of a housing defining the mop head.

Turning to FIG. 5, once a user has finished using the mop 100, they can detach the cleaning pad 204 from the mop head 101 in a "hands free manner" by translating 501 the actuator 104 toward the distal end 108 of the mop handle 102. This causes the first flexible connector 106 and the second flexible connector 107 to pull the first sides (306, 307) of the first flapper 201 and the second flapper 202 about second sides (308,309) of the first flapper 201 and the second flapper 202. This, in turn, causes the first flapper 201 and the second flapper 202 to rotate about their respective pivots (310,311) to selectively pivot 215,216 from the closed position disposed within the upper housing 301 and substantially parallel with the bottom surface 203 (as shown in FIG. 2) to the angularly displaced open position extending distally outward from the bottom surface 203 as shown in FIG. 5. In this illustrative embodiment, the first flapper 201 and the second flapper 202 extend distally outward from the bottom surface 203 at substantially an orthogonal angle relative to the bottom surface 203 when in the angularly displaced open position of FIG. 5. While substantially orthogonal angles work well at detaching 502 the cleaning pad 204, other angles will be obvious to those of ordinary skill in the art having the benefit of this disclosure.

As shown and described, embodiments of the disclosure provide a mop 100 that includes one or more flappers 201,202 disposed along the bottom surface 203 of the mop head 101. A first flexible connector 106 and a second flexible connector 107 couple the flappers 201,202 to an actuator 104. When the actuator 104 translates 501 away from the mop head 101, the flappers 201,202 pivot 215,216 open and outward, thereby detaching 502 a cleaning pad 204 from the mop head 101 without requiring a user to touch the cleaning pad 204. In some embodiments, the flappers 201,202 open from the middle of the mop head 101 toward the outside, stopping at a substantially orthogonal angle relative to the bottom surface 203 of the mop head 101. Embodiments of the disclosure advantageously allow removal of soiled cleaning pads without the unpleasant, unclean, and sometimes unsafe hand manipulation required by prior art mops.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A mop, comprising:

a housing defining a major surface to couple to a cleaning pad; and one or more flappers disposed along the major surface, the one or more flappers to selectively pivot from a closed position disposed within the housing and substantially parallel with the major surface to an angularly displaced open position extending distally outward from the major surface.

2. The mop of claim 1, the one or more flappers extending distally outward from the major surface at substantially an orthogonal angle relative to the major surface when in the angularly displaced open position.

3. The mop of claim 1, each flapper of the one or more flappers disposed interior to the major surface and surrounded by portions of the major surface.

4. The mop of claim 3, the each flapper of the one or more flappers having a first side comprising a pivot and a second side distally disposed from the first side.

5. The mop of claim 4, the one or more flappers comprising two flappers, with the second side of a first flapper and a second flapper disposed between the first side of the first flapper and the second flapper.

6. The mop of claim 5, the first flapper and the second flapper to rotate about the pivot in opposite directions.

7. The mop of claim 6, each of the first flapper and the second flapper defining a central aperture disposed between the first side and the second side.

8. The mop of claim 7, each of the first flapper and the second flapper defining a rectangular torus.

9. The mop of claim 6, further comprising at least a first spring and a second spring to apply a loading force to bias the first flapper and the second flapper in the closed position, respectively.

10. The mop of claim 6, further comprising at least a first flexible connector and a second flexible connector coupled to the second side of the first flapper and the second flapper, respectively, and extending about the first side of the first flapper and the second flapper, respectively.

11. The mop of claim 10, further comprising a mop handle coupled to the housing and extending distally away from a side of the housing disposed opposite the major surface, the at least the first flexible connector and the second flexible connector passing through the housing to an actuator disposed along the mop handle.

12. The mop of claim 11, the actuator to translate parallel to the mop handle away from the housing to cause the first flapper and the second flapper to selectively pivot from the closed position to the angularly displaced open position.

13. The mop of claim 11, further comprising a bi-axial hinge coupling the housing to the mop handle.

14. The mop of claim 1, further comprising one or more fasteners disposed along the major surface to selectively attach the cleaning pad to the housing.

15. The mop of claim 14, the major surface defining one or more apertures, the one or more flappers to selectively pivot from the closed position to the angularly displaced open position through the one or more apertures, the one or more fasteners disposed along the major surface exterior to one or more perimeters of the one or more apertures.

16. A mop, comprising:

a mop head having a top surface coupled to a mop handle and a bottom surface to couple to a cleaning pad; and one or more flappers disposed within the mop head, the one or more flappers to selectively pivot from a closed position substantially parallel with the bottom surface to an angularly displaced open position extending distally outward from the bottom surface to detach the cleaning pad from the mop head.

17. The mop of claim 16, the one or more flappers comprising a first flapper to pivot one of clockwise or counterclockwise between the closed position and the angularly displaced open position and a second flapper to pivot another of clockwise or counterclockwise between the closed position and the angularly displaced open position.

18. The mop of claim 17, the first flapper and the second flapper defining a rectangular cross section.

19. The mop of claim 17, each of the first flapper and the second flapper comprising a spring to bias the first flapper and the second flapper toward the closed position.

20. The mop of claim 19, further comprising an actuator, disposed along the mop handle and tethered to the first flapper and the second flapper, the actuator to translate linearly away from the mop head to transition the first flapper and the second flapper from the closed position to the angularly displaced open position.

* * * * *